US012691320B2

(12) United States Patent
Woo et al.

(10) Patent No.: US 12,691,320 B2
(45) Date of Patent: Jul. 28, 2026

(54) EXERCISE EQUIPMENT

(71) Applicant: LG ELECTRONICS INC., Seoul (KR)

(72) Inventors: Seyoung Woo, Seoul (KR); Jeonguk Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 392 days.

(21) Appl. No.: 18/201,866

(22) Filed: May 25, 2023

(65) Prior Publication Data

US 2023/0414986 A1 Dec. 28, 2023

Related U.S. Application Data

(60) Provisional application No. 63/356,027, filed on Jun. 27, 2022.

(30) Foreign Application Priority Data

Dec. 2, 2022 (KR) ..... 10-2022-0166354

(51) Int. Cl.
*A63B 21/04* (2006.01)
*A63B 21/00* (2006.01)

(52) U.S. Cl.
CPC ..... *A63B 21/0442* (2013.01); *A63B 21/154* (2013.01); *A63B 21/4035* (2015.10)

(58) Field of Classification Search
CPC ..... A63B 21/0442; A63B 21/154; A63B 21/4035; A63B 2071/027; A63B 21/0053;
(Continued)

(56) References Cited

U.S. PATENT DOCUMENTS 8,075,453 B1 * 12/2011 Wilkinson ..... A63B 21/4019 482/8
11,938,365 B1 * 3/2024 Dorsey ..... A63B 21/00065
(Continued)

FOREIGN PATENT DOCUMENTS

DE 102023114293 A1 * 12/2024 ..... A63B 22/0076
GB 2612311 A * 5/2023 ..... A63B 21/4049
(Continued)

OTHER PUBLICATIONS

Korean Notice of Allowance dated Aug. 23, 2024 issued in Application No. 10-2022-0166354.

*Primary Examiner* — Andrew S Lo
(74) *Attorney, Agent, or Firm* — KED & ASSOCIATES, LLP

(57) ABSTRACT

Exercise equipment may include a body provided with a mounting surface and a seating surface to support feet of a user, a load unit including a wire having one end disposed inside the body and an opposite end exposed to the mounting surface, and a load generator disposed inside the body and configured to generate a force pulling the wire into the body, a drawing-out guide including a guide fixed to the mounting surface, and a guide through-hole formed through the guide, a drawing-out hole cover including a cover body arranged to rotate about an axis parallel to a longitudinal direction or a transverse direction of the seating surface to close the guide through-hole, and a cover through-hole formed through the cover body to guide the opposite end of the wire, and a limiter arranged to limit a rotation angle of the cover body.

19 Claims, 9 Drawing Sheets

(58) Field of Classification Search
CPC ..... A63B 21/4043; A63B 23/03541; A63B 23/1209; A63B 21/153
See application file for complete search history.

(56) References Cited

U.S. PATENT DOCUMENTS

| | | | | |
|---|---|---|---|---|
| 2013/0225375 | A1* | 8/2013 | Lumsden | A63B 21/0051 482/72 |
| 2018/0280753 | A1* | 10/2018 | Krull | A63B 21/025 |
| 2019/0344123 | A1* | 11/2019 | Rubin | A63B 21/153 |
| 2022/0161088 | A1* | 5/2022 | Wilson | A63B 21/157 |
| 2022/0168606 | A1* | 6/2022 | Herring | A63B 21/153 |
| 2023/0414986 | A1* | 12/2023 | Woo | A63B 21/153 |
| 2024/0408436 | A1* | 12/2024 | Kang | A63B 23/03525 |

FOREIGN PATENT DOCUMENTS

| | | |
|---|---|---|
| KR | 10-2005-0117466 | 12/2005 |
| KR | 20-2008-0002277 | 7/2008 |
| KR | 10-2158338 | 11/2020 |
| KR | 10-2021-0028154 | 3/2021 |

* cited by examiner

EXERCISE EQUIPMENT

CROSS-REFERENCE TO RELATED APPLICATIONS

This application claims the benefit of U.S. Provisional Patent Application No. 63/356,027, filed on Jun. 27, 2022, and Korean Patent Application No. 10-2022-0166354, filed in Korea on Dec. 2, 2022, which is hereby incorporated by reference as if fully set forth herein.

BACKGROUND

1 Field

The present disclosure relates to equipment enabling a user positioned on a seating surface of a body of the equipment to exercise by pulling a wire extending out of the body through the mounting surface.

2. Background

In general, exercise equipment used for muscle strength exercises is designed to cause muscle relaxation and contraction to repeat while the user pushes or pulls a lever connected to a weight having a specific mass. Examples of the exercise equipment includes various machines such as an arm curl machine for biceps exercise, a chest press or butterfly machine for chest exercise for the pectoralis major, and a pull-up machine for muscle exercises.

Recently, as part of self-management, home training to exercise alone at home without visiting a fitness center has become popular, and various exercise machines for home training have been proposed in line with this trend. An example of the exercise machines for home training is a mat-type exercise machine, which allows the user to exercise while standing up. In the case of the mat-type exercise machine, a handle is connected to a wire exposed to the outside of the main body, and the user may exercise by repeatedly pulling the handle.

In the above-described exercise machine, the wire is repeatedly drawn out of the main body of the exercise machine and inserted into the main body. Accordingly, a structure for ensuring smooth movement of the wire in conventional exercise machines and a structure provided to prevent the wire from being caught in the outlet for entry and exit of the wire is a very important design consideration in designing the above-described exercise machine. In addition, in the case of the above-described exercise machine, foreign substances may be introduced through the wire outlet. Accordingly, a structure that minimizes the introduction of foreign substances through the outlet is also an important design consideration for ensuring durability.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to the preferred embodiments of the present disclosure, examples of which are illustrated in the accompanying drawings. Wherever possible, the same reference numbers will be used throughout the drawings to refer to the same or like parts.

Figure 1:
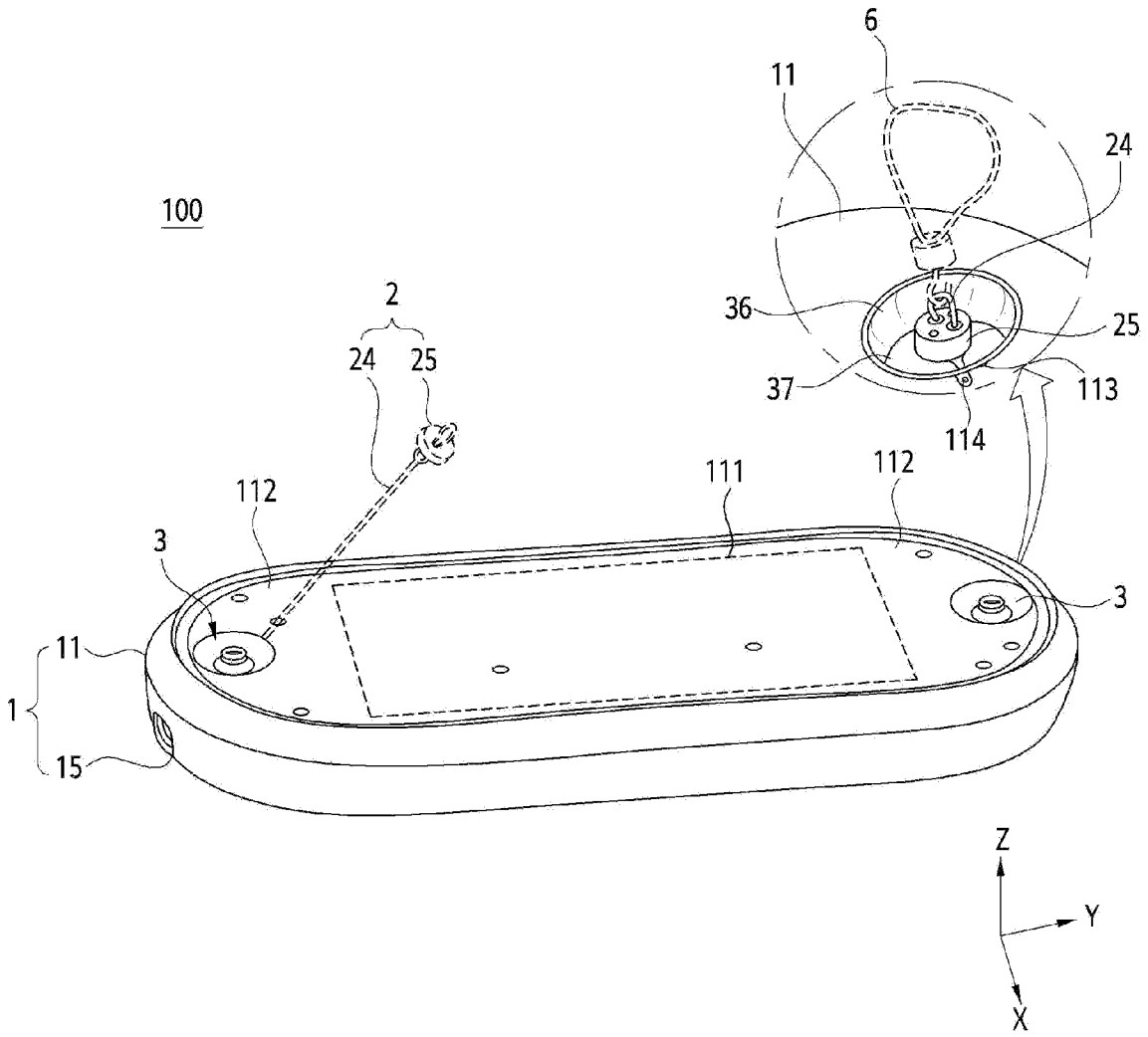
FIGS. 1 and 2 illustrate an example of an exercise equipment.

As shown in FIG. 1, exercise equipment 100 may include a body 1 provided with a seating surface 111 and a mounting surface 112, and a load unit provided with a wire 24 drawable from the body 1, and a wire guide 3 fixed to the mounting surface 112 to support the wire 24. The body 1 may include an upper case 11 having the seating surface 111 and the mounting surface 112, and a lower case 15 to which the upper case 11 is fixed.

The seating surface 111 may be provided as a space where the user's feet are supported, and the mounting surface 112 may be provided as a space where the load unit (or motor) 2 is positioned. FIG. 1 illustrates an exemplary case where the mounting surface 112 is provided with two spaces spaced apart along the horizontal direction (Y-axis direction) of the body 1 with the seating surface 111 arranged therebetween.

The body 1 may be provided with a mounting surface through-hole 113 and a fastening hole 114, which communicate with the inside of the body 1 through the mounting surface 112. The wire guide 3 may be fixed to the mounting surface 112 through the fastening hole 114 while being arranged inserted into the mounting surface through-hole 113.

Figure 2:
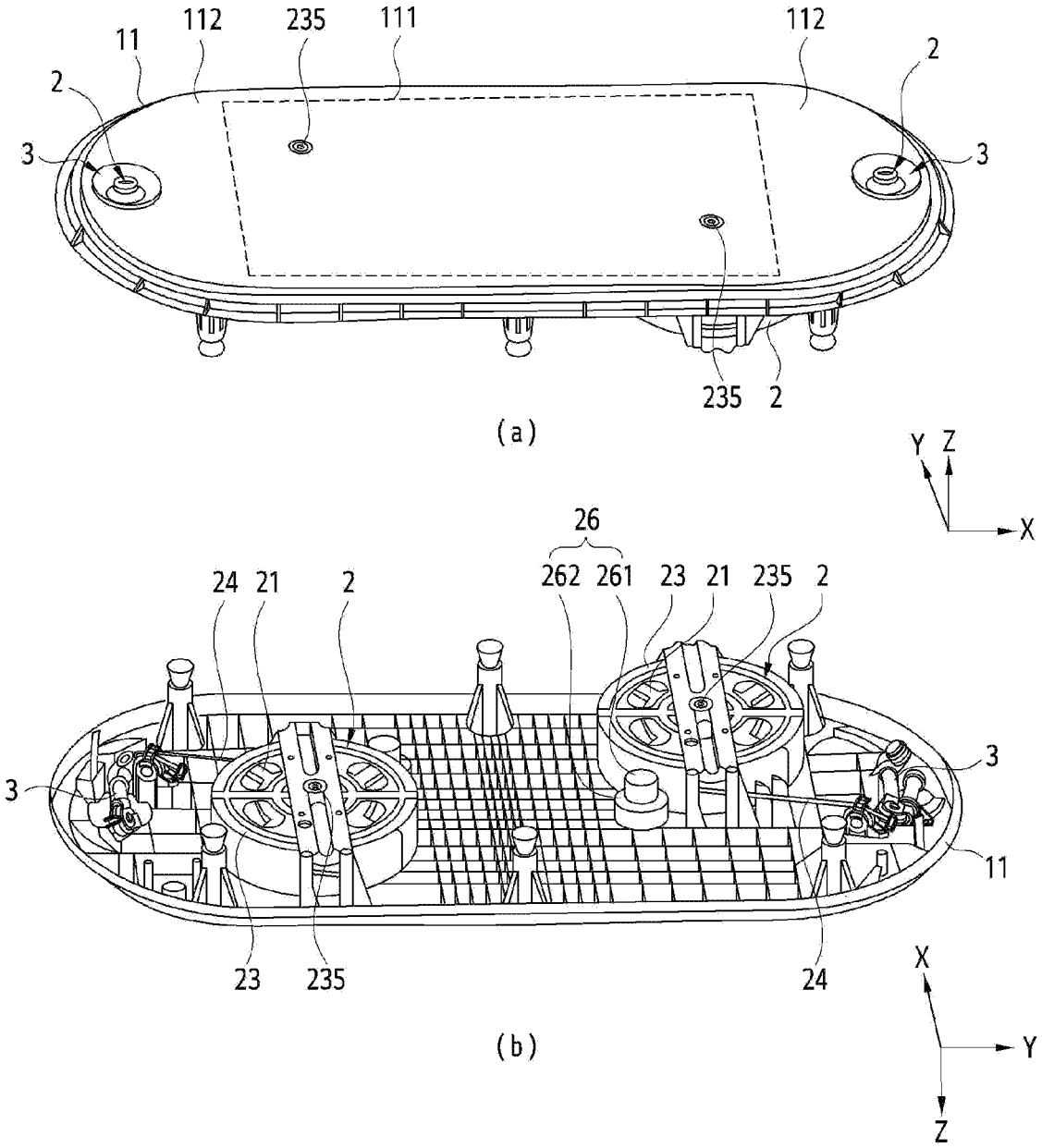

As shown in FIG. 2 (regions a and b), the load unit 2 may include the wire 24 and a load generator (or motors) 21, 23. One end of the wire 24 is disposed inside the body 1 and the opposite end thereof is arranged to be exposed to the mounting surface 112. The load generator 21, 23 is disposed inside the body 1 to fix the one end of the wire 24. The wire 24 may include a first wire drawn out of the body through the mounting surface 112 on the left side of the body 1, and a second wire drawn out of the body through the mounting surface 112 on the right side of the body 1.

The load generator is a means to generate a force that pulls the wire 24 into the body 1. When the wire has two wires, the load generator may include a first load generator configured to provide a tensile force to the first wire, and a second load generator configured to provide a tensile force to the second wire. The first wire and the second wire may have the same structure, and the first load generator and the second load generator may have the same structure.

In the example shown in FIG. 2-(region b), the load generator includes a stator 21 fixed to the upper case 11 or the lower case 15 to form a rotating field, and a rotor 23 rotatably fixed to the upper case 11 or the lower case 15 and rotated by the rotating field.

Figure 3:
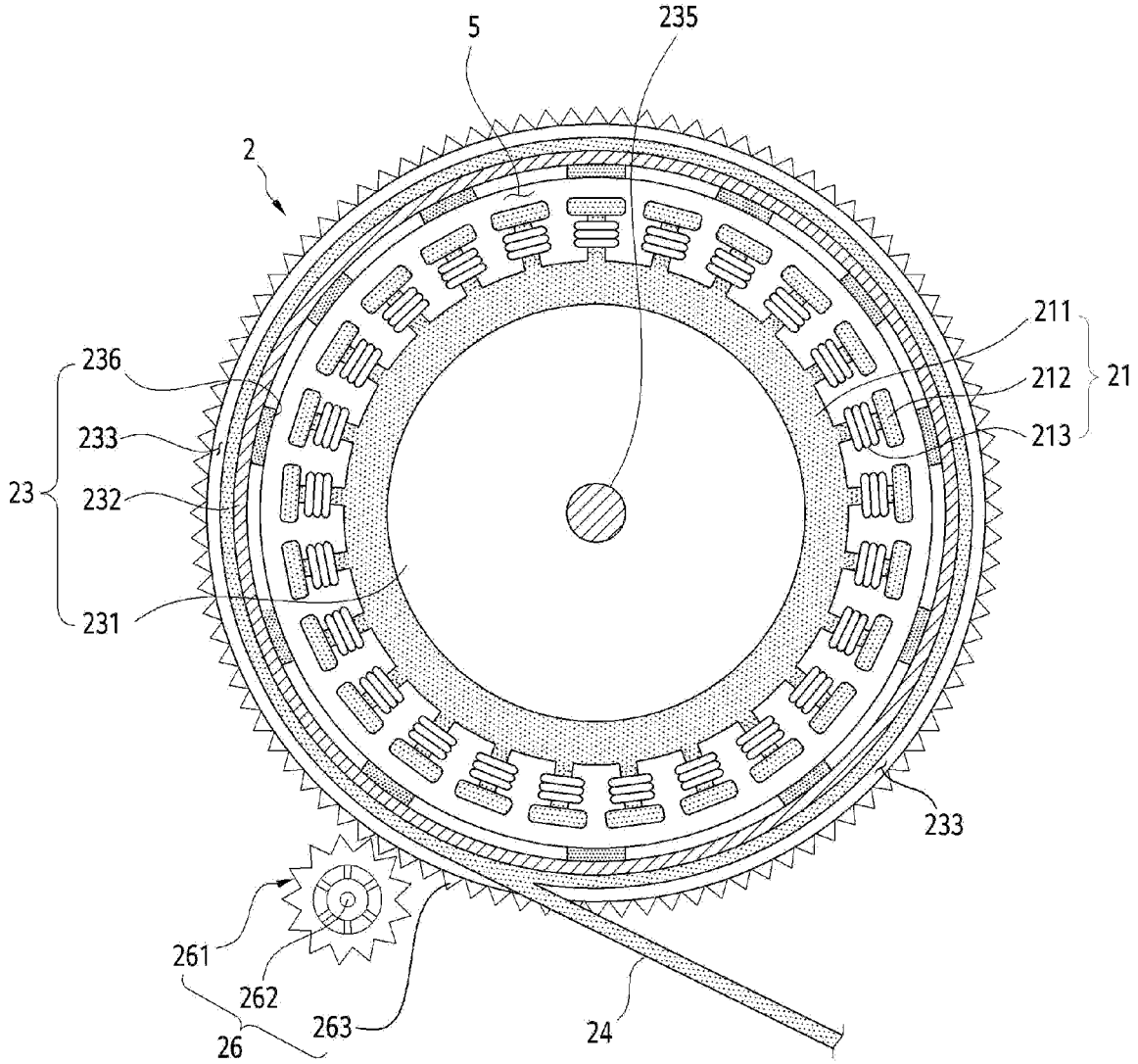
FIG. 3 illustrates an example of a load unit.

As shown in FIG. 3, the stator 21 may include a core 211 formed in a ring shape and fixed to the upper case 11, a plurality of core projections 212 protruding from a circumferential surface of the core away from the center of the core, and a coil 213 wound on the core projections. The rotor 23 may include a rotation plate 231 rotatably fixed to the upper case 11 by a rotor shaft 235, a circumferential surface 232 fixed to the rotation plate 231 and surrounding the stator, and a magnet 236 fixed to the circumferential surface 232.

The stator 21 may be arranged in an accommodation space S defined by the rotation plate 231 and the circumferential surface 232, and the magnet 236 may include a plurality of permanent magnets by which magnetic poles are alternately exposed. The permanent magnets should be fixed to the circumferential surface 232 so as to be arranged in the accommodation space S. The wire 24 may be fixed to the rotor 23, and a wire accommodating part 233 providing a space to accommodate the wire 24 may be provided in the circumferential surface 232 of the rotor 23.

The load unit 2 may further include a sensor 26 configured to detect the length of the wire 24 drawn out. FIG. 3 illustrates an exemplary case where the sensor 26 includes a rotor gear 263 provided on the circumferential surface 232 of the rotor 23, a gear 261 connected to the rotor gear 263, and an encoder 262 configured to detect a rotational angle of the gear 261.

Figure 4:
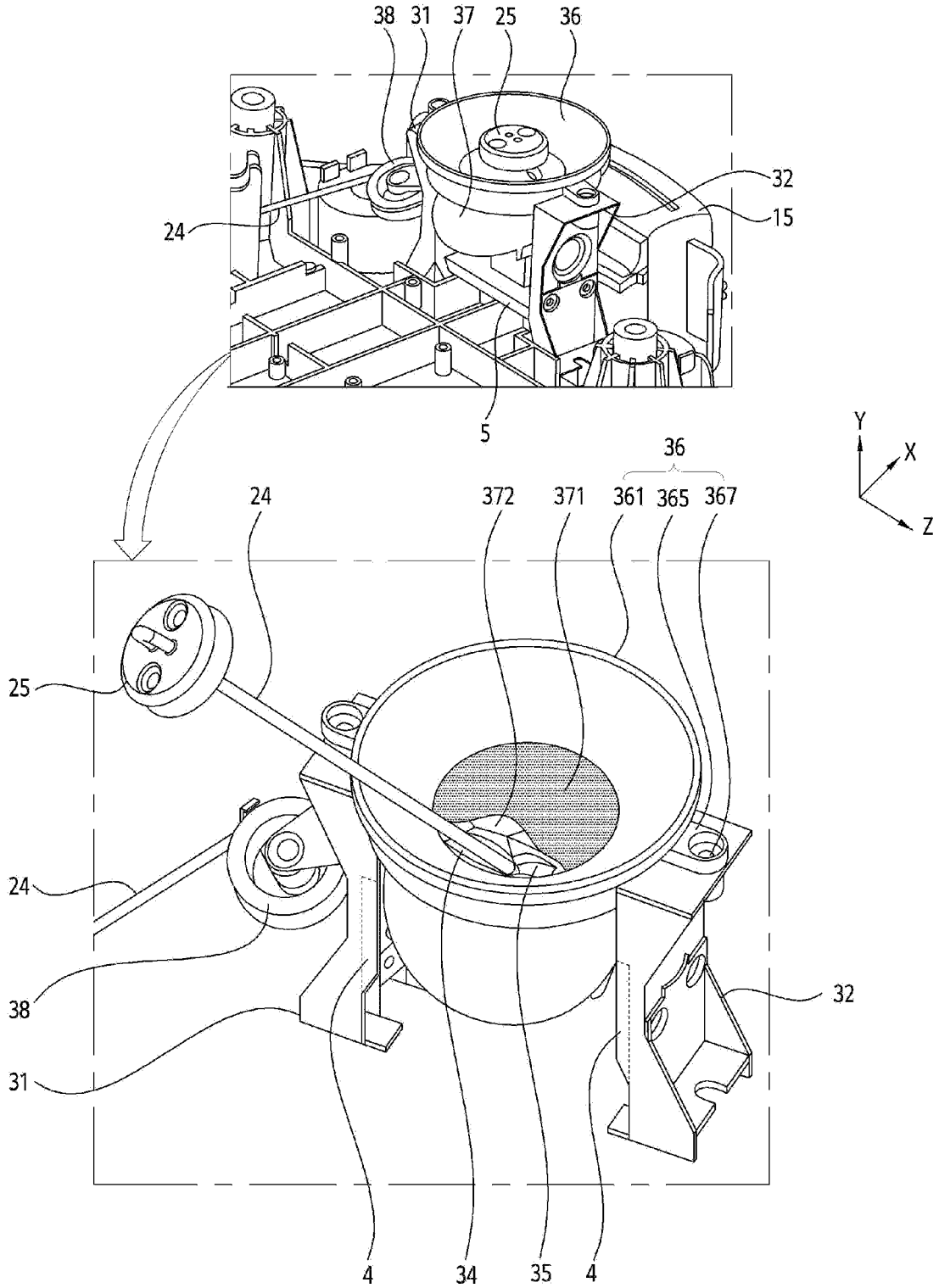
FIG. 4 illustrates an example of a wire guide.

The wire guide 3 is a means to control the drawing direction of the wire 24. The wire guide 3 is a means capable of guiding the wire 24 in at least two different directions. FIG. 4 illustrates an exemplary case where the wire guide 3 may guide the movement of the wire 24 in the longitudinal direction (Y-axis direction) of the seating surface and the transverse motion (X-axis direction) of the seating surface.

As shown in FIG. 4, the wire guide 3 may include a drawing-out guide 36 fixed to the mounting surface 112 and provided with a guide through-hole 362, and a drawing-out hole cover 37 rotatably provided to the body 1 to close the guide through-hole 362. The opposite end of the wire 24 may be supported by the drawing-out hole cover 37.

Figure 5:
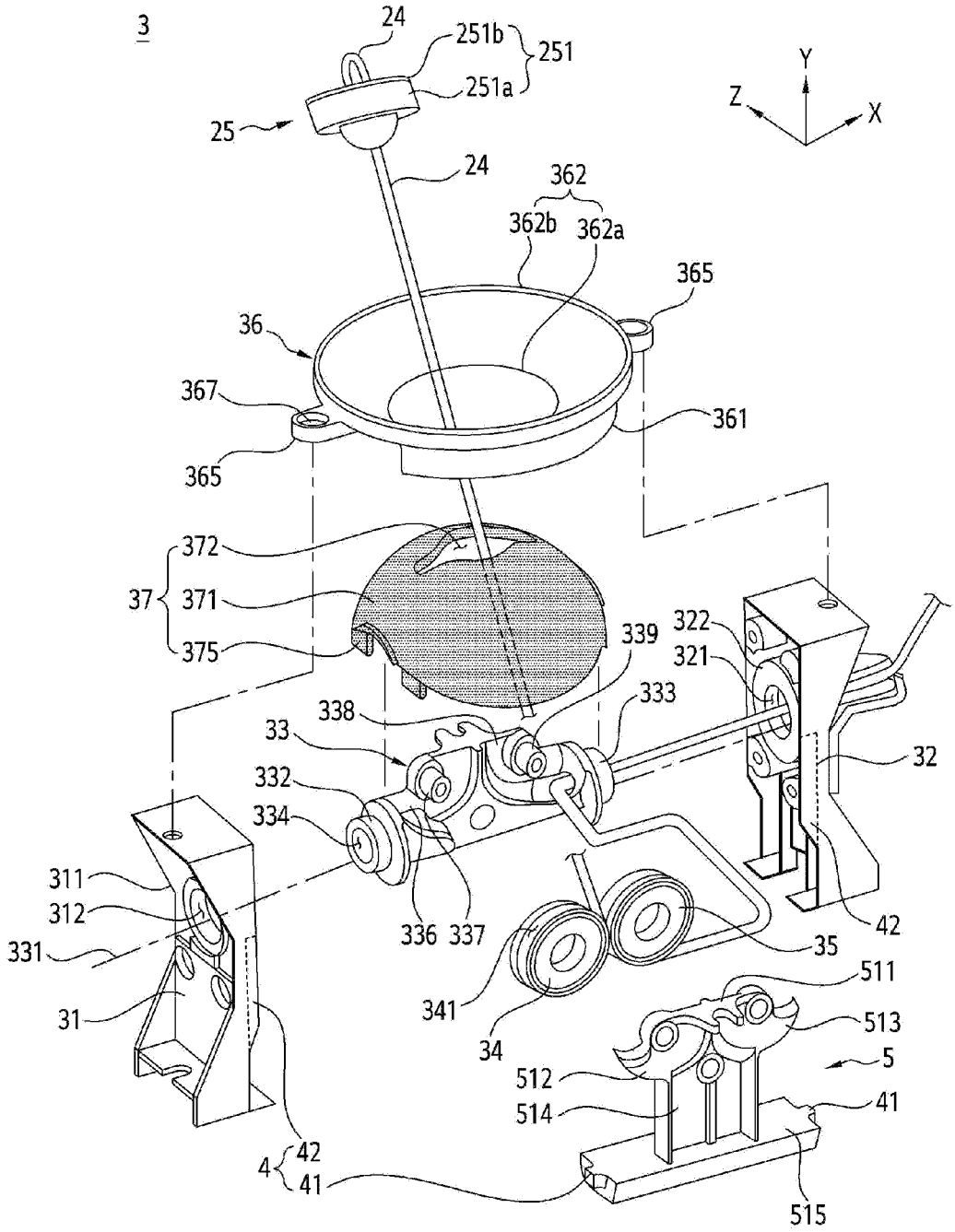
FIGS. 5 and 6 are exploded and cross-sectional views of the wire guide of FIG. 4.

The drawing-out guide 36 may include a guide 361 fixed to the mounting surface through-hole 113, and the guide through-hole 362 may be provided as a hole formed through the guide 361 in a penetrating manner. As shown in FIG. 5, the guide 361 may have a funnel shape with an upper end diameter longer than a lower end diameter. In this case, the guide through-hole 362 may include a lower drawing-out hole 362*a* positioned at the lower end of the guide 361 and an upper drawing-out hole 362*b* positioned at the upper end of the guide 361 and having a larger diameter than the lower drawing-out hole 362*a*.

A fastening rib 365 is provided on the circumferential surface of the guide 361, and a rib through-hole 367 is provided in the fastening rib 365. When the guide 361 is inserted into the through-hole 113 in the mounting surface, the rib through-hole 367 is positioned over the fastening hole 114 in the mounting surface. Accordingly, when a fastening member such as a bolt is fixed in the fastening hole 114 through the rib through-hole 367, the guide 361 will be fixed to the mounting surface 112.

The drawing-out hole cover 37 may include a cover body (or cover dome) 371 rotatably arranged inside the body 1 to close the lower drawing-out hole 362*a*, and a cover through-hole 372 formed through the cover body 371 to guide the opposite end of the wire 24 to the outside of the body 1. Since the cover body 371 is arranged to close the lower drawing-out hole 362*a*, the infiltration of foreign substances into the body 1 through the guide through-hole 362 may be minimized.

The cover body 371 may be formed in a hemispherical shape (half-dome shape) rotatable around an axis parallel to the longitudinal direction (Y-axis direction) of the body (or the longitudinal direction of the seating surface or the direction parallel to a straight line connecting the user's feet) or an axis parallel to the transverse direction (X-axis direction) of the body (or the vertical direction of the seating surface or the direction orthogonal to a straight line connecting the user's feet).

To prevent the opposite end of the wire 24 inserted into the cover through-hole 372 from moving into the body 1 (to keep the opposite end of the wire exposed to the outside of the body), a fixing member (or block) 25 may be further provided at the opposite end of the wire 24. The cover through-hole 372 may be positioned at the center of the cover body 371.

The cover body 371 may be rotatably arranged by a first support body (or first support frame) 31, a second support body (or second support frame) 32, and a connection body (or axle) 33, which are disposed inside the body 1. The first support body 31 and the second support body 32 may be spaced apart from each other along the transverse direction (X-axis direction) of the seating surface or may be spaced apart from each other along the longitudinal direction (Y-axis direction) of the seating surface. FIG. 5 shows the former case as an example.

The first support body 31 and the second support body 32 may be formed in a bar or plate shape extending from the lower case 15 toward the upper case 11. The first support body 31 includes a first bearing 312 and a first support body through-hole 311. The first support body through-hole 311 is formed through the first bearing 312 and the first support body 31 in a penetrating manner. The second support body 32 includes a second bearing 322 and a second support body through-hole 321. The second support body through-hole 321 is formed through the second bearing 322 and the second support body 32 in a penetrating manner.

One of the first support body 31 and the second support body 32 may be provided with a guide pulley (third pulley) 38 configure to guide the opposite end of the wire 24 into the first support body through-hole 311 or the second support body through-hole 321. FIG. 5 shows an exemplary case where the guide pulley 38 is fixed to the second support body 32. By providing the guide pulley 38 on one of the support bodies, friction between the wire 24 and the support body through-hole 311, 312 may be minimized.

The connection body 33 is a means to form a rotation axis of the cover body 371. The connection body 33 may be formed in a bar or plate shape having one end fixed to the first bearing 312 and an opposite end fixed to the second bearing 322. A first coupling duct 332 to be coupled to the first bearing 312 is provided at the one end of the connection body 33, and a second coupling duct 333 to be coupled to the second bearing 322 is provided at the opposite end of the connection body 33. Accordingly, the first coupling duct 332 and the second coupling duct 333 define the rotation axis 331 of the connection body.

The connection body 33 may be provided with a coupling duct through-hole formed through at least one of the first coupling duct 332 and the second coupling duct 333 in a penetrating manner. The wire 24 may be inserted into the coupling duct through-hole. FIG. 5 shows an exemplary case where the coupling duct through-hole includes a first coupling duct through-hole 334 formed through the first coupling duct 332 and a second coupling duct through-hole 335 formed through the second coupling duct 333. Depending on the position of the load generator 21, 23, the wire 24 may be inserted into the first coupling duct through-hole 334 or the second coupling duct through-hole 335.

The cover body 371 may be fixed to the first coupling duct 332 and the second coupling duct 333 through a coupling part 375. The coupling part 375 may include a first coupling groove provided in the cover body 371 and fixed to the circumferential surface of the first coupling duct 332 and a second coupling groove provided in the cover body 371 and fixed to the circumferential surface of the second coupling duct 333.

The connection body 33 may further include a first pulley 34 and a second pulley 35 configured to guide the wire 24 inserted into the first coupling duct through-hole 334 or the second coupling duct through-hole 335 to the cover through-hole 372. The first pulley 34 and the second pulley 35 may be rotatably fixed to the connection body 33, and may be spaced apart from each other along a direction (X-axis direction or transverse direction of the seating surface) parallel to the rotation axis 331 of the connection body.

In order to provide a mounting space for the pulleys, the connection body 33 may include a first accommodation groove 336 providing a space to accommodate the first pulley 34, and a second accommodation groove 338 providing a space to accommodate the second pulley 35. The first accommodation groove 336 is arranged to be connected to the first coupling duct through-hole 334, and the second accommodation groove 338 is arranged to be connected to the second coupling duct through-hole 335. A first pulley shaft 337 to which the first pulley 34 is rotatably fixed may be provided in the first accommodation groove 336, and a second pulley shaft 339 to which the second pulley 35 is rotatably fixed may be provided in the second accommodation groove 338.

The first pulley 34 is a means to guide the wire 24 to move toward a point where the first support body 31 is positioned in a direction (−X axis direction) parallel to the rotational axis 331 of the cover body 371. The second pulley 35 is a means to guide the wire 24 to move toward a point where the second support body 32 is positioned in a direction (+X axis direction) parallel to the rotation axis 331 of the cover body 371.

In order to prevent the wire 24 from escaping from the pulley during the above-described movement, a first groove 341 providing a space to accommodate the wire 24 may be provided in the circumferential surface of the first pulley 34, and a second groove 351 providing a space to accommodate the wire 24 may be provided in the circumferential surface of the second pulley 35.

Figure 6:
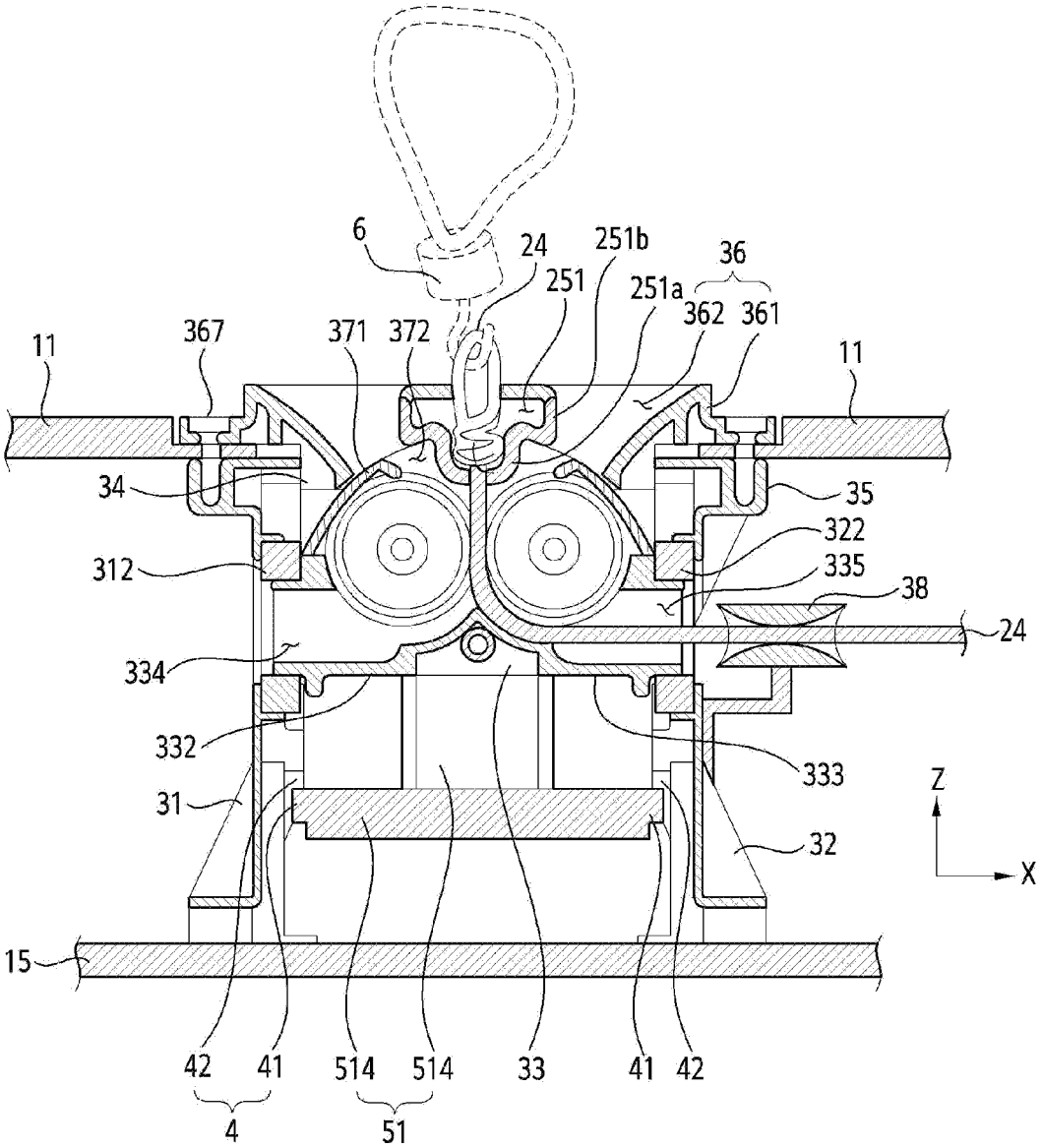

As shown in FIG. 6, the opposite end of the wire 24 is guided to a point where the first groove 341 of the first pulley and the groove 351 of the second pulley face each other, through the second support body through-hole 321 and the second coupling duct through-hole 335. The wire 24 passing through the point where the first groove 341 and the groove 351 face each other is guided to the outside of the body 1 through the cover through-hole 372. Since the fixing member 25 is provided at the opposite end of the wire 24, the wire 24 drawn out of the body 1 remains exposed to the outside of the body 1.

Figure 7:
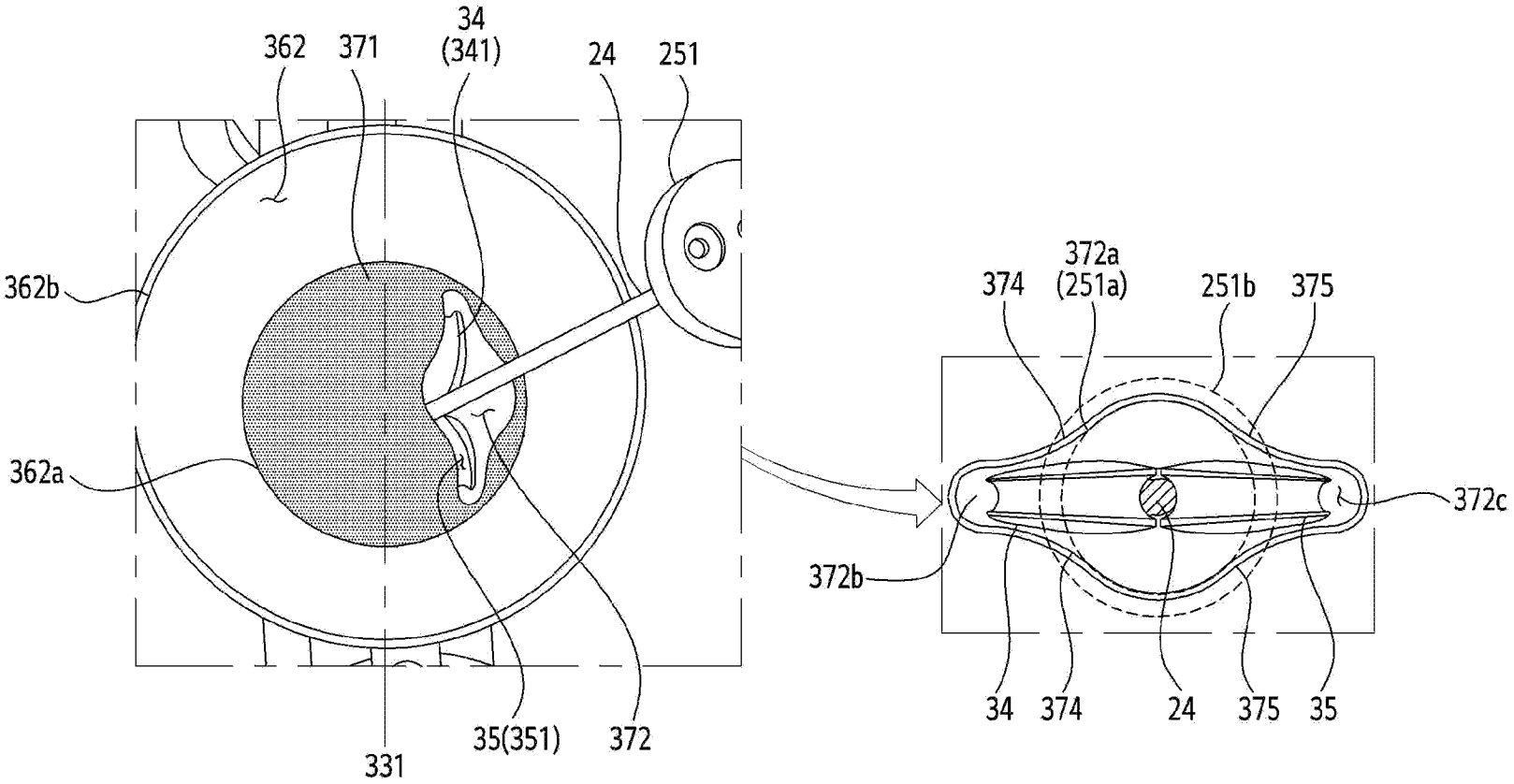
FIGS. 7 and 8 illustrate an embodiment of a cover through-hole.

As shown in FIG. 7, the cover through-hole 372 may include a wire drawing hole (or wire drawing hole section) 372*a* formed in a circular shape, a first slit (or first slit section) 372*b* extending from an edge of the wire drawing hole 372*a* toward the first support body 31, and a second slit (or second slit section) 372*c* extending from the edge of the wire drawing hole 372*a* toward the second support body 32. The wire drawing hole 372*a* may be positioned above the point where the first groove 341 of the first pulley and the second groove 351 of the second pulley face each other. The first slit 372*b* is a means to prevent interference between the wire 24 and the cover body 371 when the wire 24 is drawn out toward the first support body 31, and the second slit 372*c* is a means to prevent interference between the wire 24 and the cover body 371 when the wire 24 is drawn out toward the second support body 32.

As shown in the figures, the first pulley 34 and the second pulley 35 are arranged to close a portion of the cover through-hole 372. Accordingly, the exercise equipment 100 may minimize the infiltration of foreign substances into the body 1 through the cover through-hole 372.

As shown in FIG. 6, the fixing member 25 may include a fixing body (or block) 251 to which the opposite end of the wire 24 is fixed. The fixing member 25 may close at least a portion of the cover through-hole 372. A portion of the wire 24 may be exposed to the outside of the fixing body 251 through one surface of the fixing body 251, and a user may exercise after connecting a handle 6 to the wire 24 exposed to the outside of the fixed body 251.

The fixing body 251 may include a first seating body (or first block section) 251*a* inserted into the cover through-hole 372 and positioned above the point where the first groove 341 and the second groove 351 face each other, and a second seating body (or second block section) 251*b* positioned above the first seating body 251*a* to close at least a portion of the cover through-hole 372. The diameter of the second seating body 251*b* may be set longer than the diameter of the first seating body 251*a* and the diameter of the wire drawing hole 372*a*. When the diameter of the second seating body 251*b* is configured as described above, the second seating body 251*b* may close the wire drawing hole 372*a*, a portion of the first slit 372*b*, and a portion of the second slit 372*c*. Accordingly, the exercise equipment 100 equipped with the second seating body 251*b* may minimize the infiltration of foreign substances into the body 1 through the cover through-hole 372.

Since the first seating body 251*a* inserted into the cover through-hole 372 is positioned above the point where the groove 341 of the first pulley and the groove 351 of the second pulley face each other, the infiltration of foreign substances through the space where the two grooves 341 and 351 face each other may be minimized.

Figure 8:
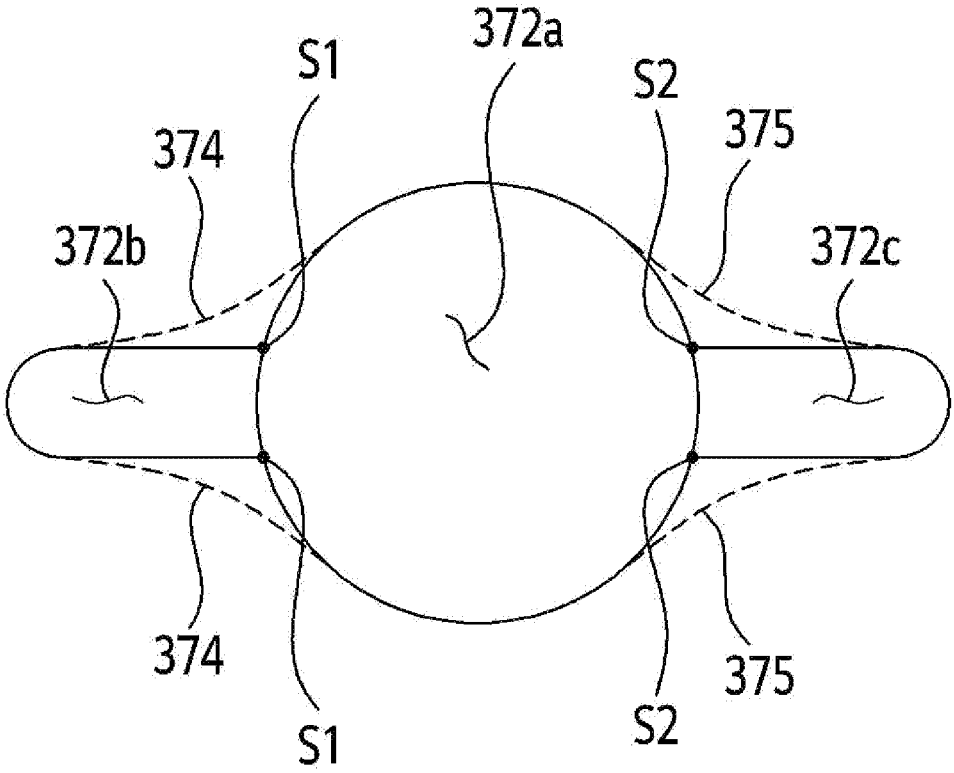

As shown in FIG. 8, the cover through-hole 372 may further include a first bent portion (or first bent surface) 374 and a second bent portion (or second bent surface) 375. The first bent portion 374 may be provided at two points where the edge of the wire drawing hole 372*a* and the edge of the first slit 372*b* are connected, and may be provided as a curved surface that is curved toward a connection point S1 between the wire drawing hole and the first slit. The second bent portion 375 may be provided at two points where the edge of the wire drawing hole 372*a* and the edge of the second slit 372*c* are connected, and may be provided as a curved surface that is curved toward a connection point S1 between the wire drawing hole and the second slit.

Depending on the direction in which the user pulls the wire 24, the wire 24 may pass through the connection point S1 between the wire drawing hole and the first slit or the connection point S2 between the wire drawing hole and the second slit. When the first bent portion 374 and the second bent portion 375 are provided at the connection points S1 and S2, respectively, friction between the wire 24 and the cover body 371 may be reduced, and accordingly durability of the wire 24 may be enhanced.

Figure 9:
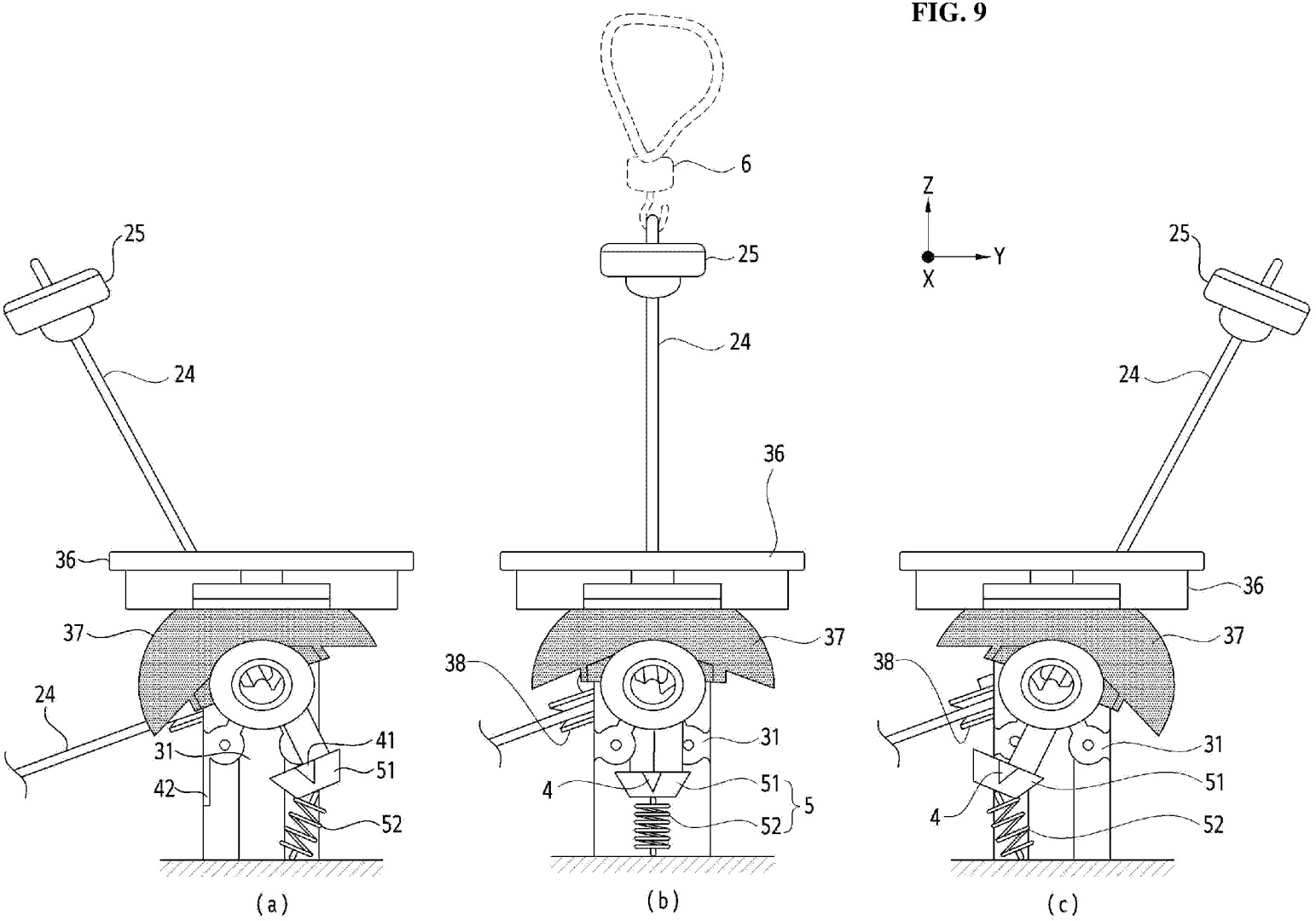
FIG. 9 illustrates an operation of the wire guide.

FIG. 9 illustrates an operation of the exercise equipment 100 having the above-described structure. The user may draw the wire 24 out of the body 1 by pulling the handle 6 after fastening the handle 6 to the fixing member 25. In this case, the load generators 21 and 23 may provide a load of a magnitude selected by the user to the wire 24.

FIG. 9-(region b) illustrates a case where the user pulls the wire 24 in a direction (Z direction) perpendicular to the seating surface, and FIG. 9-(region a) illustrates a case where the user pulls the wire 24 inward (toward the center of the seating surface or in the −Y axis direction), and FIG.

9-(region c) illustrates a case where the user pulls the wire 24 away from the position of the user (i.e., in the +Y axis direction). Although not shown in the figures, in the cases of FIGS. 9-(region a) to 9-(region c), the user may pull the wire 24 toward the first support body 31 (in the −X axis direction) or toward the second support body 32 (in the +X axis direction). In the case of FIG. 9-(region b), when the wire 24 is pulled toward the first support body 31, the wire 24 may move in the plane formed by the −X axis and the +Z axis. In the case of FIG. 9-(region b), when the wire 24 is pulled toward the second support body 32, the wire 24 may move in the plane formed by the +X axis and the +Z axis.

In the case of FIG. 9-(region a) or FIG. 9-(region c), in order to return the cover body 371 in to the initial position (FIG. 9-(region a)), the exercise equipment 100 may further include a restoring force provider (or restoring force mechanism) 5. The restoring force provider 5 may be configured to provide restoring force to make the cover through-hole 372 positioned at the center of the guide through-hole 362, and may include at least one of a first provider (or counter weight) 51 and a second provider (or spring) 52.

As shown in FIG. 5, the first provider 51 may include an extension body (or extension wall) 514 formed in a bar or plate shape protruding from the connection body 33 toward the lower case 15, and a count weight (or counter weight) 515 fixed to a free end of the extension body 514. The extension body 514 may be coupled to the connection body 33 through a fastening body 511. FIG. 5 shows that the fastening body 511 is fixed to the connection body 33 through the first pulley shaft 337 and the second pulley shaft 339.

The fastening body 511 may include a first pulley cover 512 configured to prevent the first pulley 34 from being drawn out of the first accommodation groove 336, and a second pulley cover 513 configured to prevent the second pulley 35 from being drawn out of the second accommodation groove 338 once the fastening body 511 is coupled to the first pulley shaft 337 and the second pulley shaft 339.

The count weight 515 is fixed to the connection body 514 so as to be positioned on the opposite side of the fastening body 511. Accordingly, the cover body 371 positioned as shown in FIG. 9-(region a) or 9-(region c) may be returned to the state of FIG. 9-(region b) by the weight of the count weight 515.

As shown in FIG. 9, the second provider 52 may be provided as a spring. When the first provider 51 has the above-described structure, the second provider 52 may connect the count weight 515 and the body 1 or connect the extension body 514 and the body 1. Unlike the configuration shown in the figures, the restoring force provider 5 may include only the extension body 514 fixed to the connection body 33 and a spring connecting the extension body 514 to the body 1.

As shown in FIG. 7, when the cover body 371 rotates, the cover through-hole 372 may contact the edge of the guide through-hole 362 or escape from the edge of the guide through-hole 362. That is, when the cover body 371 rotates, the edge of the cover through-hole 372 may come into contact with the edge of the lower drawing-out hole 362*a*.

When the edge of the cover through-hole 372 contacts the edge of the lower drawing-out hole 362*a*, the possibility of infiltration of foreign substances into the body 1 through the cover through-hole 372 increases, and the possibility of the wire 24 being caught between the cover body 371 and the guide 361 increases. In order to minimize the possibilities, the exercise equipment 100 may further include a limiter 4 configured to prevent the edge of the cover through-hole 372 from contacting the edge of the lower drawing-out hole 362*a*.

As shown in FIG. 5, the limiter 4 may include a protrusion 41 provided to at least one of both ends of the count weight 515, and a stopper (or stopper wall) 42 provided to at least one of the first support body 31 and the second support body 32 so as to contact the protrusion 41 when the cover body 371 rotates by a preset reference angle or more. The reference angle may be set to an angle at which the edge of the cover through-hole 372 contacts the edge of the lower drawing-out hole 362*a*.

Unlike the configuration shown in the figures, the limiter 4 may be configured to prevent the connection body 33 from rotating beyond the reference angle. In addition, the limiter 4 may include a protrusion provided to the extension body 514, and a stopper provided to at least one of the first support body 31 and the second support body 32 so as to contact the protrusion when the cover body 371 rotates more than the preset reference angle.

In addition, the limiter 4 may include a protrusion provided to the cover body 371, and a stopper provided to the guide 361 so as to contact the protrusion when the cover body 371 rotates more than a preset reference angle. Therefore, the exercise equipment 100 may not only smoothly guide the movement of the wire 24, but also minimize the possibility of infiltration of foreign substances into the body through the guide through-hole and the possibility of the wire 24 being caught in the wire guide 3.

An object of the present disclosure is to provide exercise equipment capable of smoothly guiding the movement of a wire. Another object of the present disclosure is to provide exercise equipment capable of minimizing the infiltration of foreign substances into the body thereof through a drawing-out hole through which a wire is drawn. Another object of the present disclosure is to provide exercise equipment capable of minimizing the possibility of a wire being caught in a drawing-out hole or the like. Another object of the present disclosure is to provide exercise equipment capable of providing a restoring force to a wire guide configured to guide the movement of a wire such that the wire guide may be arranged at an initial position when the exercise equipment is not in use.

To achieve these objects and other advantages and in accordance with the purpose of the disclosure, as embodied and broadly described herein, exercise equipment may include a body provided with a mounting surface and a seating surface to support feet of a user, a load unit including a wire having one end disposed inside the body and an opposite end exposed to the mounting surface, and a load generator disposed inside the body to fix the one end of the wire, the load generator being configured to generate a force pulling the wire into the body, a drawing-out guide including a guide fixed to the mounting surface, and a guide through-hole formed through the guide, a drawing-out hole cover including a cover body arranged to rotate about an axis parallel to a longitudinal direction of the seating surface or an axis parallel to a transverse direction of the seating surface to close the guide through-hole, and a cover through-hole formed through the cover body to guide the opposite end of the wire to the outside of the body, and a limiter arranged to limit a rotation angle of the cover body to prevent an edge of the cover through-hole from contacting an edge of the guide through-hole to prevent infiltration of foreign substances through the cover through-hole or jamming of the wire.

The exercise equipment a first support body and a second support body fixed inside the body and spaced apart from each other along the longitudinal direction of the seating surface or the transverse direction of the seating surface, and a connection body having one end rotatably fixed to the first support body and an opposite end rotatably fixed to the second support body, wherein the cover body may be fixed to the connection body.

The exercise equipment may further include a first pulley and a second pulley rotatably fixed to the connection body and spaced apart from each other in a direction parallel to a rotational axis of the connection body to guide the wire into the cover through-hole. The first pulley and the second pulley may be arranged to close at least a portion of the cover through-hole.

The exercise equipment may further include a first groove formed along a circumferential surface of the first pulley to provide a space to accommodate the wire, and a second groove formed along a circumferential surface of the second pulley to provide a space to accommodate the wire. A position where the first groove and the second groove face each other is in a center of the cover through-hole.

The exercise equipment may further include a fixing member, wherein the opposite end of the wire may be fixed to the fixing member. The fixing member may include a first seating body inserted into the cover through-hole and disposed above the position where the first groove and the second groove face each other, and a second seating body having a larger diameter than the first seating body and positioned above the first seating body to close at least a portion of the cover through-hole.

The cover through-hole includes a wire drawing hole formed in a circular shape and disposed above the position where the first groove and the second groove face each other, a first slit extending from an edge of the wire drawing hole toward the first support body to prevent interference between the wire and the cover body, and a second slit extending from the edge of the wire drawing hole toward the second support body to be disposed on a side opposite to the first slit to prevent the interference between the wire and the cover body.

The exercise equipment may further include a first bent portion provided at two positions connecting the edge of the wire drawing hole and an edge of the first slit, the first bent portion being bent toward a connection point between the wire drawing hole and the first slit, and a second bent portion provided at two positions connecting the edge of the wire drawing hole and an edge of the second slit, the second bent portion being bent toward a connection point between the wire drawing hole and the second slit.

The limiter may include a protrusion provided on the cover body, and a stopper provided on the guide so as to come into contact with the protrusion when the cover body rotates by a preset reference angle or more. The limiter may be arranged to prevent the connection body from rotating beyond the preset reference angle.

The exercise equipment may further include a restoring force provider configured to provide a restoring force to make the cover through-hole positioned in a center of the guide through-hole. The restoring force provider may include an extension body protruding from the connection body in a direction away from the mounting surface, and a spring arranged to connect the extension body to the body.

The limiter may include a protrusion provided on the extension body, and a stopper provided on at least one of the first support body or the second support body and configured to contact the protrusion when the cover body rotates by a preset reference angle or more. The restoring force provider may include an extension body protruding from the connection body in a direction away from the mounting surface, and a count weight fixed to a free end of the extension body. The exercise equipment may further include a spring arranged to connect the count weight and the restoring force provider or to connect the extension body and the body.

The limiter may include a protrusion provided on the count weight, and a stopper provided on at least one of the first support body or the second support body and configured to contact the protrusion when the cover body rotates by a preset reference angle or more.

According to the present disclosure, exercise equipment capable of smoothly guiding the movement of a wire may be provided. According to the present disclosure, exercise equipment capable of minimizing the infiltration of foreign substances into the body thereof through a drawing-out hole through which a wire is drawn may be provided. According to the present disclosure, exercise equipment capable of minimizing the possibility of a wire being caught in a drawing-out hole or the like may be provided. According to the present disclosure, exercise equipment capable of providing a restoring force to a wire guide configured to guide the movement of a wire may be provided such that the wire guide may be arranged at an initial position when the exercise equipment is not in use.

It is to be understood that both the foregoing general description and the following detailed description of the present disclosure are exemplary and explanatory and are intended to provide further explanation of the disclosure as claimed. It will be apparent to those skilled in the art that various modifications and variations can be made in the present disclosure without departing from the spirit and scope of the disclosure. Thus, it is intended that the present disclosure covers the modifications and variations of this disclosure provided they come within the scope of the appended claims and their equivalents.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An exercise equipment comprising:

a body including a mounting surface;

a wire having a first end and a second end;

a motor positioned inside the body and coupled to the first end of the wire, the motor being configured to generate a force pulling the wire into the body;

a guide provided at the mounting surface and including a guide through-hole;

a cover provided at the guide through-hole and configured to rotate about an axis, the cover including a cover through-hole that guides the second end of the wire to an outside of the body, a first support frame and a second support frame provided inside the body and spaced apart from each other along the axis of rotation of the cover; and a connection axle having a first end rotatably coupled to the first support frame and a second end rotatably coupled to the second support frame;

wherein the cover is coupled to the connection axle, and the cover through-hole does not reach the guide through-hole during a rotation of the cover.

2. The exercise equipment of claim 1, further comprising:

a first pulley and a second pulley rotatably coupled to the connection axle and spaced apart from each other in a direction parallel to a rotational axis of the connection axle to guide the wire into the cover through-hole, wherein the first pulley and the second pulley are positioned under a portion of the cover through-hole.

3. The exercise equipment of claim 2, further comprising:

a first groove formed along a circumferential surface of the first pulley to provide a first space to accommodate the wire; and a second groove formed along a circumferential surface of the second pulley to provide a second space to accommodate the wire, wherein the connection axle positioned the first pulley and the second pulley so that a position where the first groove and the second groove face each other under a center of the cover through-hole.

4. The exercise equipment of claim 3, further comprising:

a fixing block, wherein the second end of the wire is coupled to the fixing block, and wherein the fixing block includes:

a first seating body section inserted into the cover through-hole and positioned above the position where the first groove and the second groove face each other when the wire is in a retracted state; and a second seating body section having a larger width than the first seating body section in a least one direction and positioned above the first seating body to at least partially shield the cover through-hole when the wire is in the retracted state.

5. The exercise equipment of claim 3, wherein the cover through-hole include:

a wire drawing hole section formed in a rounded shape and positioned above the position where the first groove and the second groove face each other;

a first slit section extending from an edge of the wire drawing hole in a first direction toward the first support frame; and a second slit section extending from the edge of the wire drawing hole in a second direction toward the second support frame, the second direction being opposite to the first direction.

6. The exercise equipment of claim 5, wherein the cover further includes:

first bent surfaces provided at two positions connecting the edge of the wire drawing hole section and an edge of the first slit section, each of the first bent surfaces being bent toward a corresponding connection point between the wire drawing hole section and the first slit section; and second bent surfaces provided at two positions connecting the edge of the wire drawing hole section and an edge of the second slit section, each of the second bent surfaces being bent toward a corresponding connection point between the wire drawing hole and the second slit.

7. The exercise equipment of claim 1, further comprising:

a protrusion coupled to one of the cover or the guide; and a stopper wall coupled to another one of the cover or the guide and positioned so as to come into contact with the protrusion when the cover rotates by at least a preset reference angle.

8. The exercise equipment of claim 7, wherein the connection axle is prevented from rotating beyond the preset reference angle.

9. The exercise equipment of claim 1, further comprising:

an extension wall having a first end coupled to the connection axle and extending in a direction away from the mounting surface, the extension wall being configured to provide a restoring force to rotate the cover to a set position.

10. The exercise equipment of claim 9, wherein further comprising:

a spring that connects the extension wall to the body.

11. The exercise equipment of claim 9, further comprising:

a protrusion provided on the extension wall; and a stopper wall provided on at least one of the first support frame or the second support frame and configured to contact the protrusion when the cover rotates by at least a preset reference angle.

12. The exercise equipment of claim 9, further comprising:

a counter weight coupled to a second end of the extension wall that is opposite to the first end coupled to the connection axle.

13. The exercise equipment of claim 12, further comprising:

a spring that connects at least one of the counter weight or the extension body to the body.

14. The exercise equipment of claim 12, further comprising:

a protrusion provided on the counter weight; and a stopper wall provided on at least one of the first support frame or the second support frame and configured to contact the protrusion when the cover rotates by at least a preset reference angle.

15. The exercise equipment of claim 9, wherein, when the cover is positioned at the set position, the cover through-hole is positioned in a center of the guide through-hole.

16. The exercise equipment of claim 2, further comprising a third pulley coupled to at least one of the first or second support frames and configured to guide the wire to one of the first or second pulleys.

17. The exercise equipment of claim 1, wherein the body includes a seating surface to support a user, and wherein the axis of rotation of the cover extends parallel to a longitudinal direction of the seating surface or parallel to a transverse direction of the seating surface.

18. An exercise equipment comprising:

a case having a through-hole;

a cover provided inside the case and at the through-hole, the cover including an opening;

a first support frame and a second support frame provided inside the case and spaced apart from each other;

a connection axle rotatably coupled to the first support frame and the second support frame, the cover being coupled to the connection axle to rotate along an extension direction of the connection axle; and a wire extending through the through-hole and the opening of the cover, wherein the opening of the cover does not reach the through-hole during a rotation of the cover.

19. An exercise equipment comprising:

a body having a through-hole;

a first support frame and a second support frame provided inside the body and spaced apart from each other;

a dome including an opening and rotatably coupled to the first support frame and the second support frame to at least partially cover the through-hole;

a wire extending through the through-hole of the body and the opening of the dome;

a protrusion coupled to the dome; and a stopper wall provided in the body and positioned so as to contact the protrusion when the dome rotates by a reference angle.

* * * * *